US005862554A

United States Patent [19]

Lu

[11] Patent Number: 5,862,554

[45] Date of Patent: Jan. 26, 1999

[54] TOE CAP SETTING MACHINE

[76] Inventor: Shun-Tsung Lu, No. 160-2, Sec. 2, Fu Hsing Rd., Taichung, Taiwan

[21] Appl. No.: 969,759

[22] Filed: Nov. 13, 1997

[51] Int. Cl.[6] ..... A43D 8/00; A43D 11/00

[52] U.S. Cl. ..... 12/123; 12/11.3; 12/54.1; 12/54.2; 12/61 R; 12/64

[58] Field of Search ..... 12/123, 112, 107 A, 12/8.8, 9, 11.3, 14.5, 54.2, 59.7, 61 R, 64, 54.1, 51

[56] References Cited

U.S. PATENT DOCUMENTS

| | | | |
|---|---|---|---|
| 3,309,725 | 3/1967 | Staden | 12/146 |
| 3,397,417 | 8/1968 | Kamborian et al. | 12/123 |
| 3,451,083 | 6/1969 | Pedretti | 12/11.3 |
| 3,594,839 | 7/1971 | Bailey | 12/10.5 |
| 4,502,411 | 3/1985 | Gilbride et al. | 12/123 |
| 4,709,433 | 12/1987 | Walega | 12/8.2 |

*Primary Examiner*—M. D. Patterson
*Attorney, Agent, or Firm*—Burns, Doane, Swecker & Mathis, L.L.P.

[57] ABSTRACT

A toe cap setting machine includes at least one cooling mechanism having a shoe last fixedly connected to a post with a heating tube disposed below the shoe last which is disposed between two work plates each having a slide slidably disposed thereon. Each of the work plates has a cylinder disposed therebelow which has a cylinder rod extending through the work plate and the slide. A first jaw extends from each of the slides and is located beside the shoe last. A second jaw is pivotally connected to a root portion of each of the first jaws and contacts the cylinder rod of the cylinder corresponding thereto at a bottom of the second jaw so as to clamp a toe cap between the first and the second jaw when the cylinder rod is operated. A light emitting device is disposed above the shoe last.

6 Claims, 8 Drawing Sheets

TOE CAP SETTING MACHINE

BACKGROUND OF THE INVENTION

1. Field of the Invention

The present invention relates to a toe cap setting machine comprising a plurality of clamping devices for positioning the toe cap on a shoe last of the setting machine so as to correctly dispose the toe cap on the shoe last.

2. Brief Description of the Prior Art

A toe cap setting machine is used to set the toe cap at a desired configuration. The toe cap is generally made of a sheet of leather which is first softened by being neated on a heating means and then put on a shoe last which is generally a curved solid member. In order to securely position the sheet of leather on the shoe last so as to set the leather into a configuration the same as that of the shoe last, a positioning apparatus is used to compresses the sheet of leather so that the sheet of leather is snugly mounted to the shoe last and therefore set to have the desired configuration after it is cooled. However, the apparatus compress the sheet of leather within a short of time and this action often slightly moves the sheet of leather on the shoe last so that the configuration of the toe cap does not consistently meet a desired requirement.

The present invention intends to provide an improved toe cap setting machine comprising clamping devices to mitigate and/or obviate the above-mentioned problems.

SUMMARY OF THE INVENTION

The present invention provides a toe cap setting machine which includes at least one cooling mechanism including a shoe last fixedly connected to a post with a cooling tube disposed below the shoe last. Two work plates are respectively disposed to two sides of the shoe last and each has a slide slidably disposed thereon. A cylinder is disposed below each of the work plates and has a cylinder rod extending through the work plate and the slide. A first jaw extends from each of the slides and is located beside the shoe last. A second jaw is pivotally connected to a root portion of the corresponding first jaw and has a bottom thereof contacting the cylinder rod so that when the cylinder rod extends, the second jaw is pivoted toward the first jaw. A light emitting device is disposed above the shoe last.

It is an object of the present invention to provide a toe cap setting machine which has at least two clamping devices adjustably disposed around the corresponding shoe last.

It is another object of the present invention to provide a toe cap setting machine wherein a height of the shoe last thereof can be adjustable.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
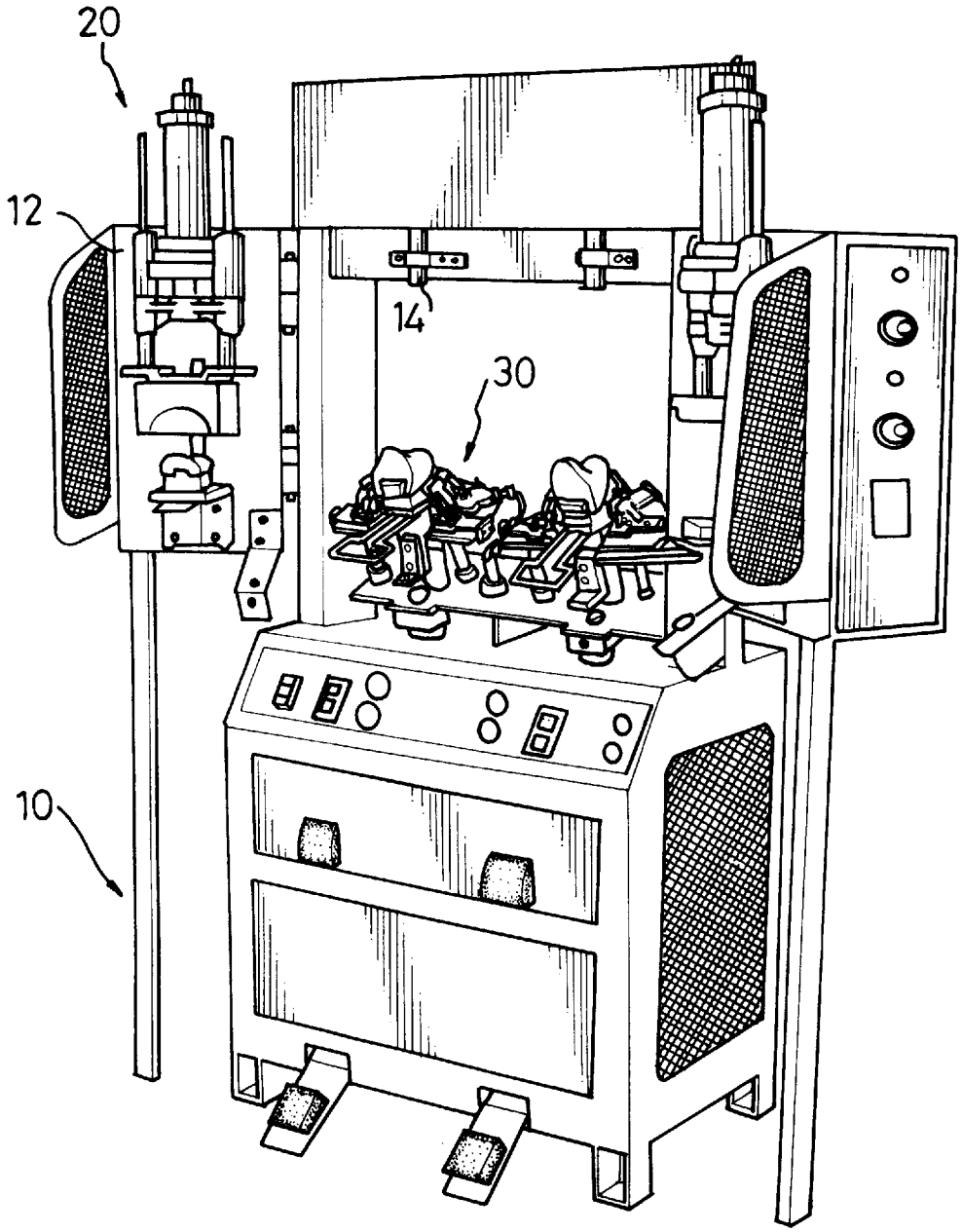
FIG. 1 is a perspective view of a toe cap setting machine in accordance with the present invention.
Figure 2:
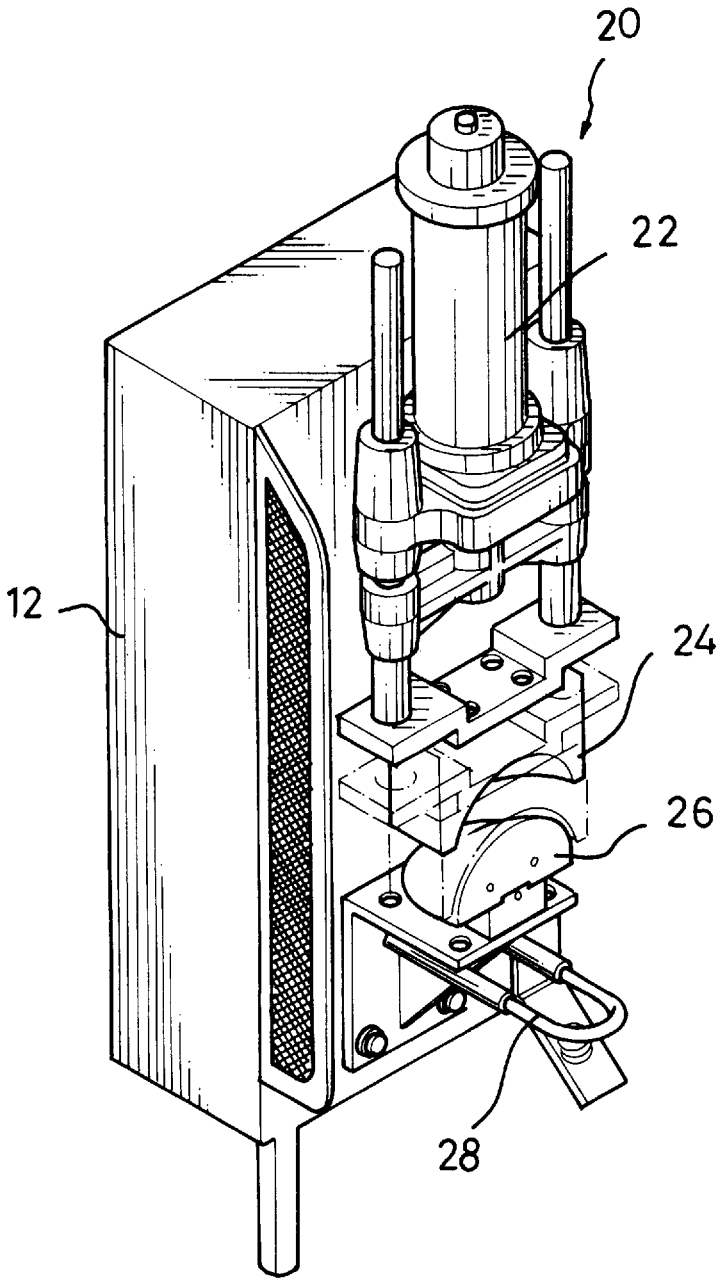
FIG. 2 is a perspective view of a heating mechanism of the toe cap setting machine in accordance with the present invention.

Referring to the drawings and initially to FIGS. 1 and 2, a toe cap setting machine in accordance with the present invention generally includes a base 10, two heating mechanisms 20 respectively located beside the base 10 and two cooling mechanisms 30 disposed to the base 10. Each of the heating mechanisms 20, as shown in FIG. 2, includes a control box 12, an upper mold 24 controlled by a cylinder 22, a lower mold 26 fixedly disposed to the control box 12, and a heating tube 28 disposed below the lower mold 26. A sheet of leather, for example, to be made a toe cap (not shown) is disposed between the upper and the lower mold 24, 26 and heated by the heating tube 28 so that the sheet of the leather is soft and deformable.

Figure 3:
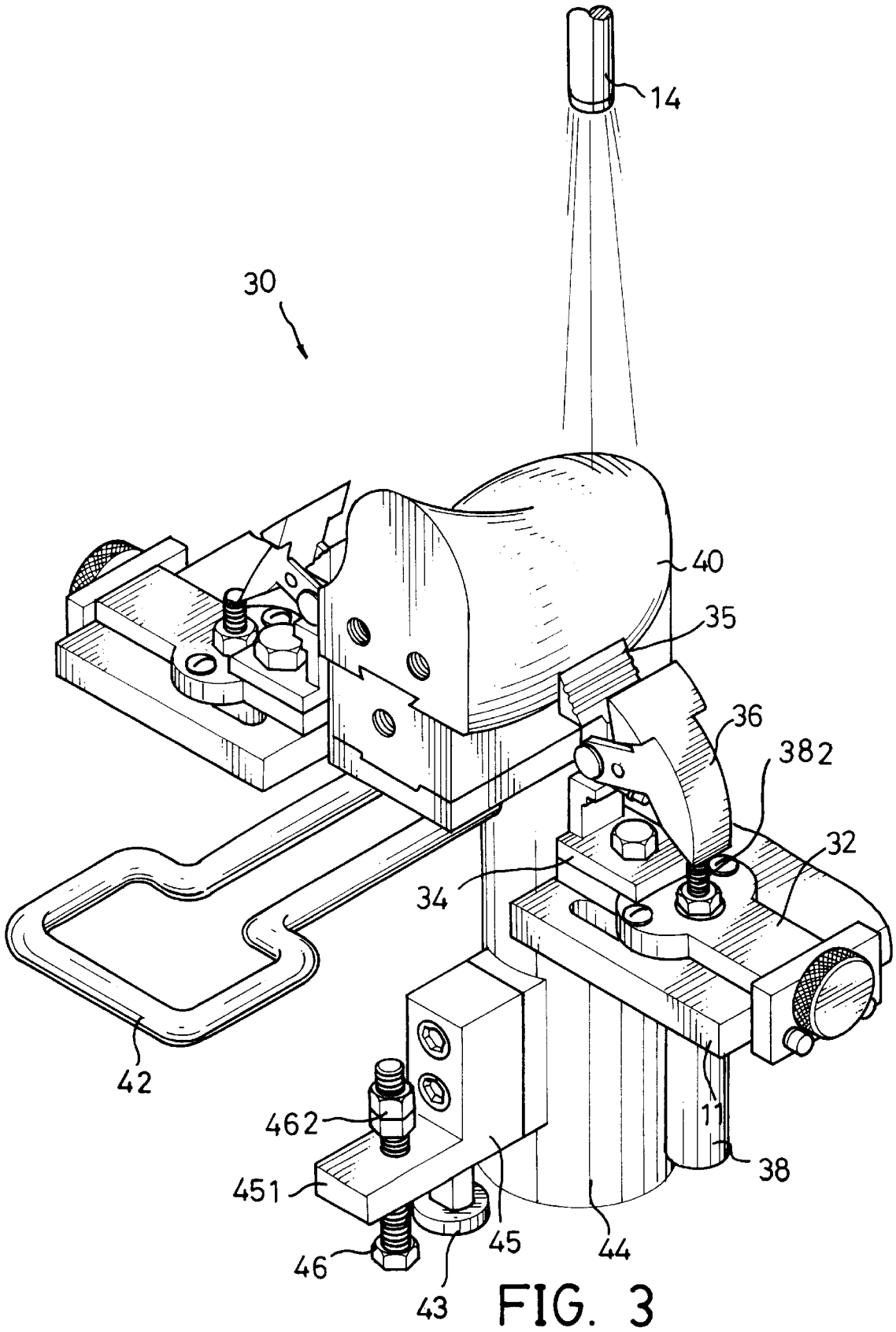
FIG. 3 is a perspective view of a cooling mechanism of the toe cap machine in accordance with the present invention.
Figure 4:
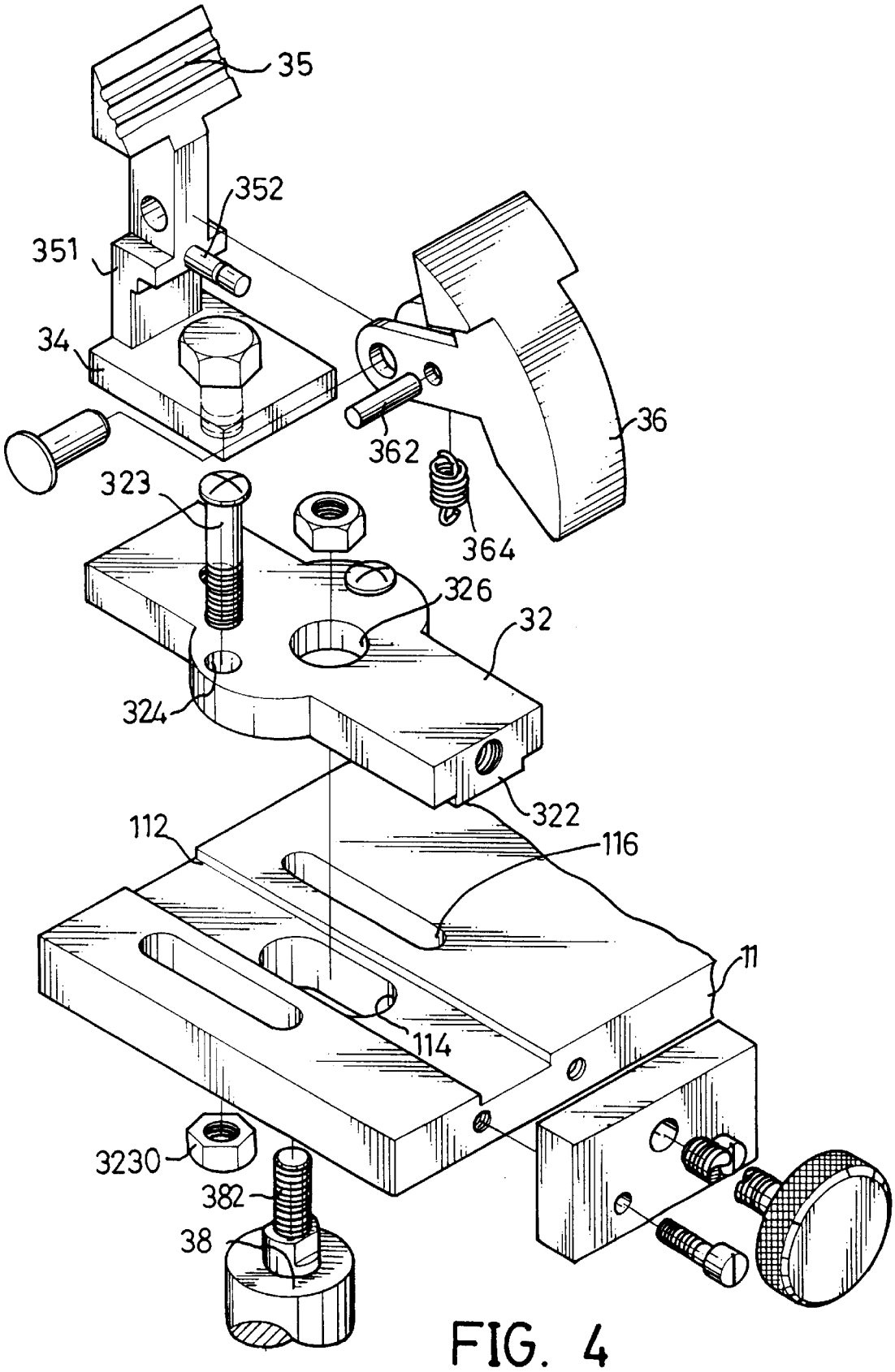
FIG. 4 is an exploded view of a part of the cooling mechanism in accordance with the present invention.
Figure 5:
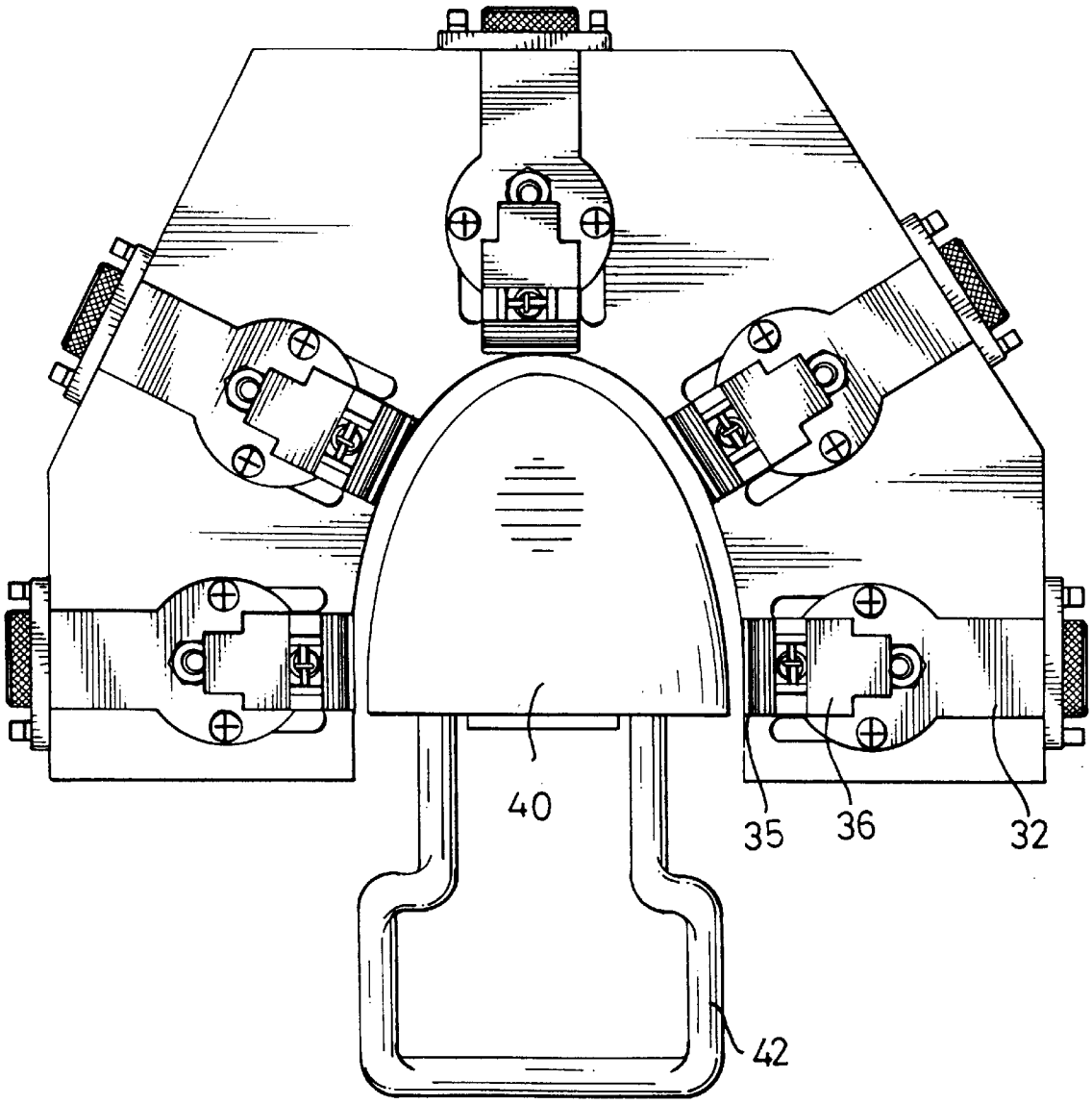
FIG. 5 is a top plan view of the cooling mechanism of the present invention.
Figure 7:
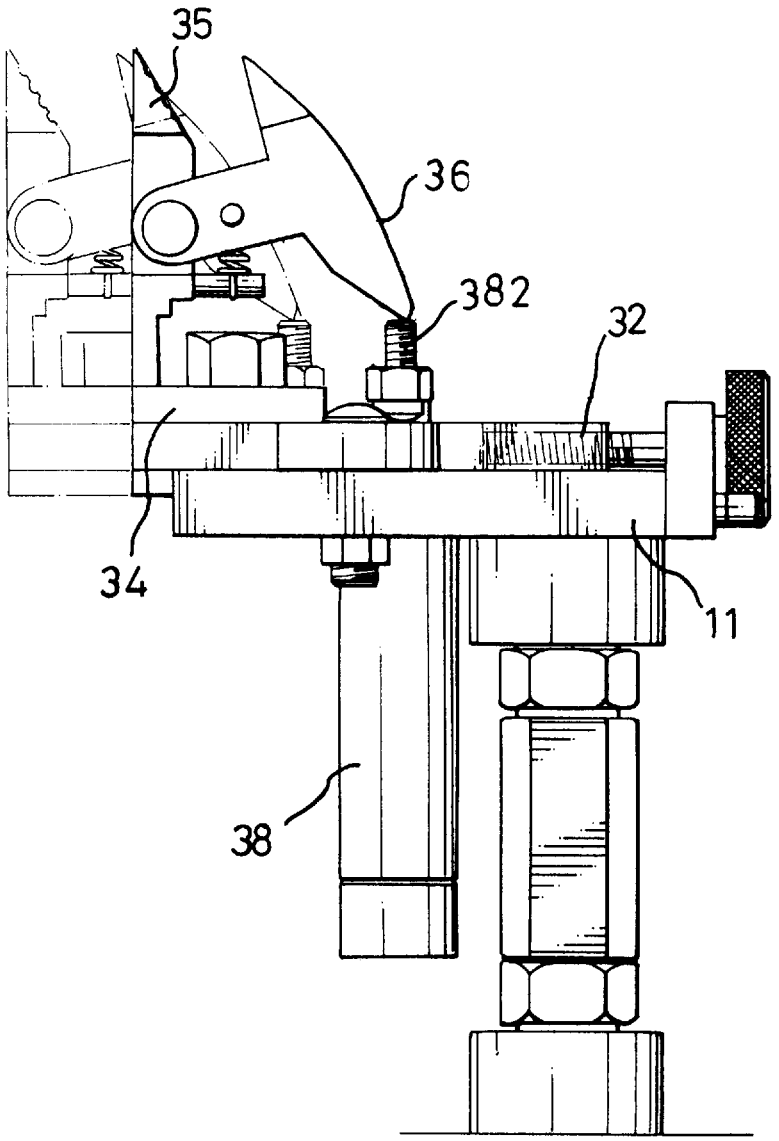
FIG. 7 is a side elevational view to show the clamping device of the present invention is adjusted.

Referring to FIGS. 3 through 5, each of the cooling mechanisms 30 includes a shoe last 40 fixedly connected to a post 44 which is telescopic means, a cooling tube 42 disposed below the shoe last 40, two work plates 11 respectively disposed to two sides of the corresponding shoe last 40 and each having a slide 32 slidably disposed thereon. Each of the work plates 11 has a first cylinder 38 disposed therebelow which has a cylinder rod 382 having a threaded outer periphery. Each of the work plates 11 has a groove 112 defined in an upper surface thereof and an oblong hole 114 is defined through a bottom partly defining the groove 112. Two elongated slots 116 are respectively defined through each of the work plates 11 and located on two sides of the groove 112. Each of the slides 32 has a ridge 322 extending from a bottom thereof so as to be slidably received in the groove 112 corresponding thereto. Each of the slides 32 has two holes 324 defined therethrough and a central hole 326 is defined between the two holes 324 so that each pair of the corresponding elongated slot 116 and the hole 324 have a bolt 323 extending therethrough which is engaged with a nut 3230 to set a position of the slide 32 (see FIG. 7). The cylinder rod 382 extends through oblong hole 114 and the central hole 326 of the work plate 11 and the slide 32.

Each of the slides 32 has a clamping device disposed thereto which includes a plate 34 fixedly disposed to an end thereof and a first jaw 35 extends from the plate 34 and is located beside the shoe last 40. A second jaw 36 is pivotally connected to a root portion of the first jaw 35 corresponding thereto and contacts the cylinder rod 382 of the cylinder 38 corresponding thereto at a bottom of the second jaw 36. The root portion 351 of each of the first jaws 35 has a rod 352 extending laterally therefrom and the second jaw 36 corresponding to the first jaw 35 has a pin 362 extending transversely therethrough so as to connect a spring 364 between the rod 352 and the pin 362 so that when the cylinder rod 382 extends upwardly, the second jaw 36 is pivoted toward the first jaw 35. When the cylinder rod 382 is retracted, the second jaw 36 will return to an original position thereof by a force of the spring 364.

A light emitting device 14 (see FIG. 3) is disposed above the shoe last 40 so as to emit light on the shoe last 40 to facilitate positioning of the sheet of leather.

Figure 6:
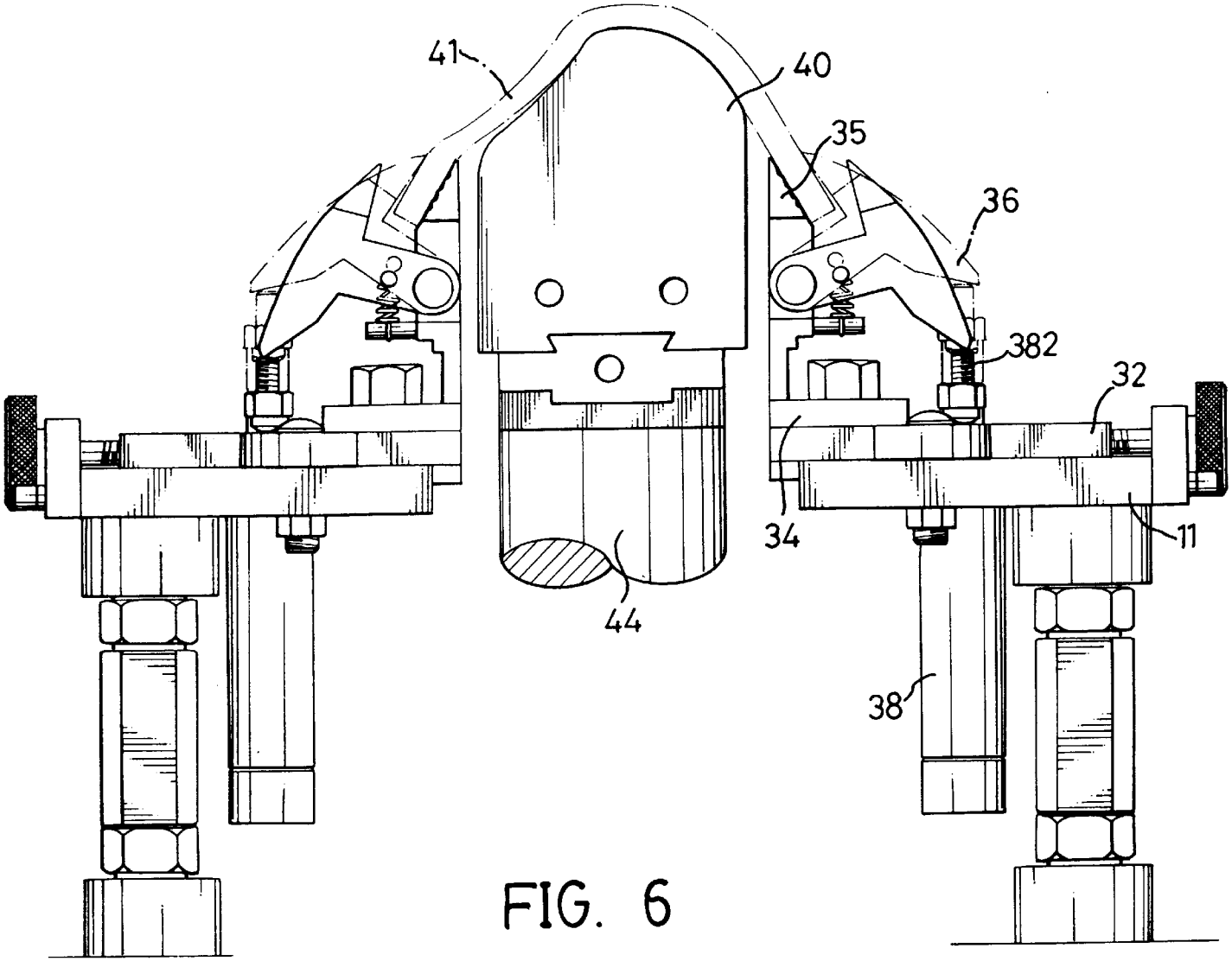
FIG. 6 is a side elevational view of the cooling mechanism and showing a toe cap is clamped by clamping devices of the cooling mechanism of the present invention.

Referring to FIG. 6, when the softened sheet of leather 41 (shown in phantom lines) is put on the shoe last 40 and its position is checked by using the light emitting device 14, the first cylinders 38 are then operated to extend the cylinder rods 382 upwardly to let the second jaws 36 be pivoted to clamp the sheet of leather 41 so that the sheet of leather 41 is snugly mounted on the shoe last 40.

Figure 8:
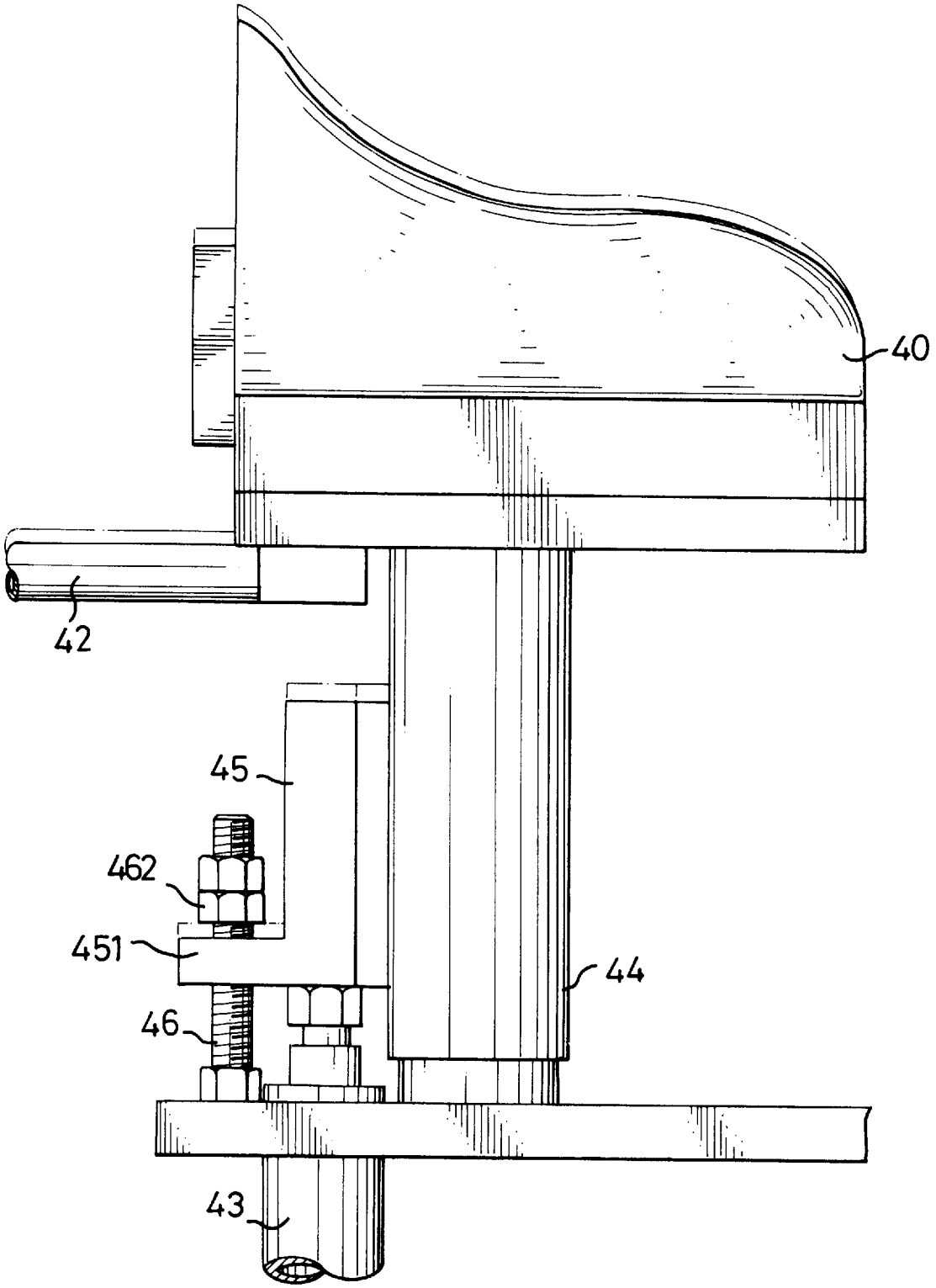
FIG. 8 is a side elevational view to show a height of the shoe last is adjusted.

Referring to FIG. 8, the post 44 has a block 45 connected thereto which has a protrusion 451 extending laterally therefrom. The block 45 is connected to a second cylinder 43 and the protrusion 451 has a threaded rod 46 extending therethrough which is fixedly connected to a part of the machine. A limit nut 462 is adjustably mounted to the threaded rod 46 so that a stroke of the second cylinder 43 is limited by the protrusion 451 contacting the limit nut 462 so as to ensure a snugly contacting between the sheet of leather 41 and the shoe last 40.

Although the invention has been explained in relation to its preferred embodiment, it is to be understood that many other possible modifications and variations can be made without departing from the spirit and scope of the invention as hereinafter claimed.

What is claimed is:

1. A toe cap setting machine comprising:

at least one cooling mechanism including a shoe last fixedly connected to a post, a cooling tube disposed below said shoe last, two work plates respectively disposed to two sides of said corresponding shoe last and each having a slide slidably disposed thereon, each of said work plates having a cylinder disposed therebelow which has a cylinder rod extending through said work plate and said slide, a first jaw extending from each of said slides and located beside said shoe last, a second jaw pivotally connected to a root portion of said first jaw corresponding thereto and contacting said cylinder rod of said cylinder corresponding thereto at a bottom of said second jaw so that when said cylinder rod extends, said second jaw is pivoted toward said first jaw, and a light emitting device disposed above said shoe last.

2. The toe cap setting machine as claimed in claim 1 wherein said root portion of each of said first jaws has a rod extending laterally therefrom and said second jaw corresponding to said first jaw has a pin extending transversely therethrough so as to connect a spring between said rod and said pin.

3. The toe cap setting machine as claimed in claim 1 wherein each of said work plates has a groove defined in an upper surface thereof and said corresponding slide has a ridge extending from a bottom thereof so as to be slidably received in said groove.

4. The toe cap setting machine as claimed in claim 1 wherein each of said work plates has two elongated slots defined in two sides of a periphery defining said groove, each of said slides having two holes defined therethrough so that each pair of said corresponding elongated slot and said hole have a bolt extending therethrough which is engaged with a nut.

5. The toe cap setting machine as claimed in claim 1 wherein each of said work plates has an oblong hole defined therethrough and each of said slides has a central hole defined therethrough so as to allow said cylinder rod to extend therethrough.

6. The toe cap setting machine as claimed in claim 1 wherein said post has a block connected thereto which has a protrusion extending laterally therefrom, said block connected to a second cylinder and said protrusion having a threaded rod extending therethrough which is fixedly connected to a part of said machine, a limit nut adjustably mounted to said threaded rod so that a stroke of said second cylinder is limited by said protrusion contacting said limit nut.

* * * * *